United States Patent [19]

Goller et al.

[11] Patent Number: 4,649,721

[45] Date of Patent: Mar. 17, 1987

[54] KNITTING INSTRUMENT CARRIER FOR KNITTING MACHINES

[75] Inventors: Ernst Goller, Reutlingen; Eugen Staiger, Trochtelfingen, both of Fed. Rep. of Germany

[73] Assignee: H. Stoll GmbH & Co., Fed. Rep. of Germany

[21] Appl. No.: 873,342

[22] Filed: Jun. 12, 1986

[30] Foreign Application Priority Data

Jun. 13, 1985 [DE] Fed. Rep. of Germany ..... 3521234

[51] Int. Cl.[4] ..... D04B 15/00; D04B 35/00

[52] U.S. Cl. ..... 66/115

[58] Field of Search ..... 66/115, 114

[56] References Cited

U.S. PATENT DOCUMENTS

| | | | |
|---|---|---|---|
| 1,210,108 | 12/1916 | Schwartz et al. | 66/115 |
| 2,623,372 | 12/1952 | Zielinski | 66/115 |
| 3,509,737 | 5/1970 | Shima | 66/115 |

FOREIGN PATENT DOCUMENTS

| | | | |
|---|---|---|---|
| 1057691 | 3/1954 | France | 66/115 |
| 2098770 | 3/1972 | France | 66/115 |
| 449166 | 6/1949 | Italy | 66/115 |
| 496074 | 6/1954 | Italy | 66/115 |
| 547780 | 9/1956 | Italy | 66/115 |

*Primary Examiner*—Ronald Feldbaum

*Attorney, Agent, or Firm*—Larson and Taylor

[57] ABSTRACT

A knitting instrument carrier (10), having grooves which are confined by alternate demarcation strips (27) and bearing strips (28) following one after the other, which are in rows on common anchor bars (29–31). An accurate division of the knitting instrument carrier (10) is assured by holding bars (16–18), on which the common anchor bars (29–31) are clamped and which are provided with divisionally accurate edge grooves (21–23) in which the demarcation strips (27) interlock with projections. The loop-forming projections with their nib (39) manufactured separately from the demarcation strips (27) are also made up of individual laminations (FIG. 1).

8 Claims, 7 Drawing Figures

Figure 1:
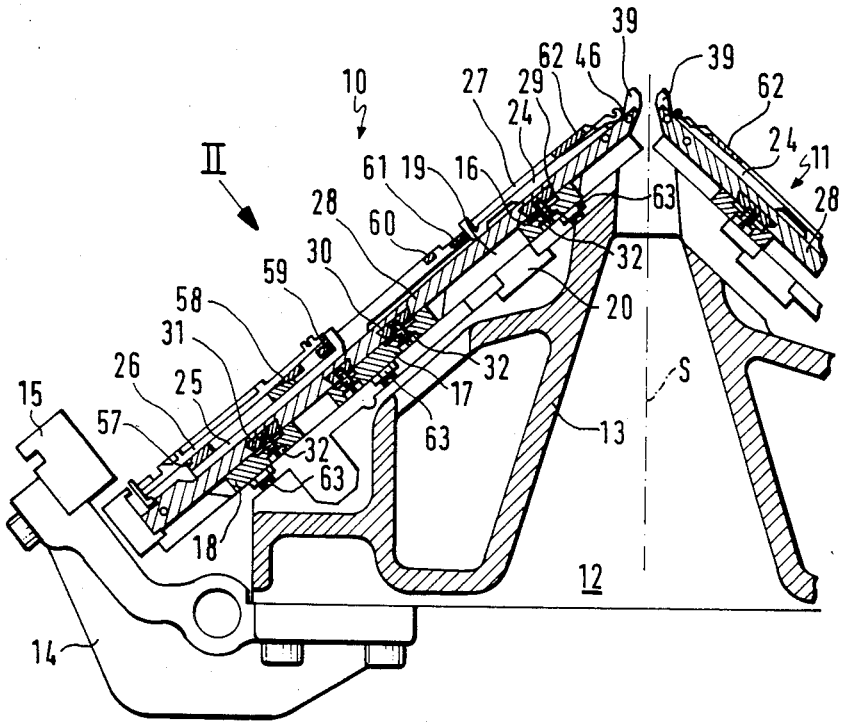

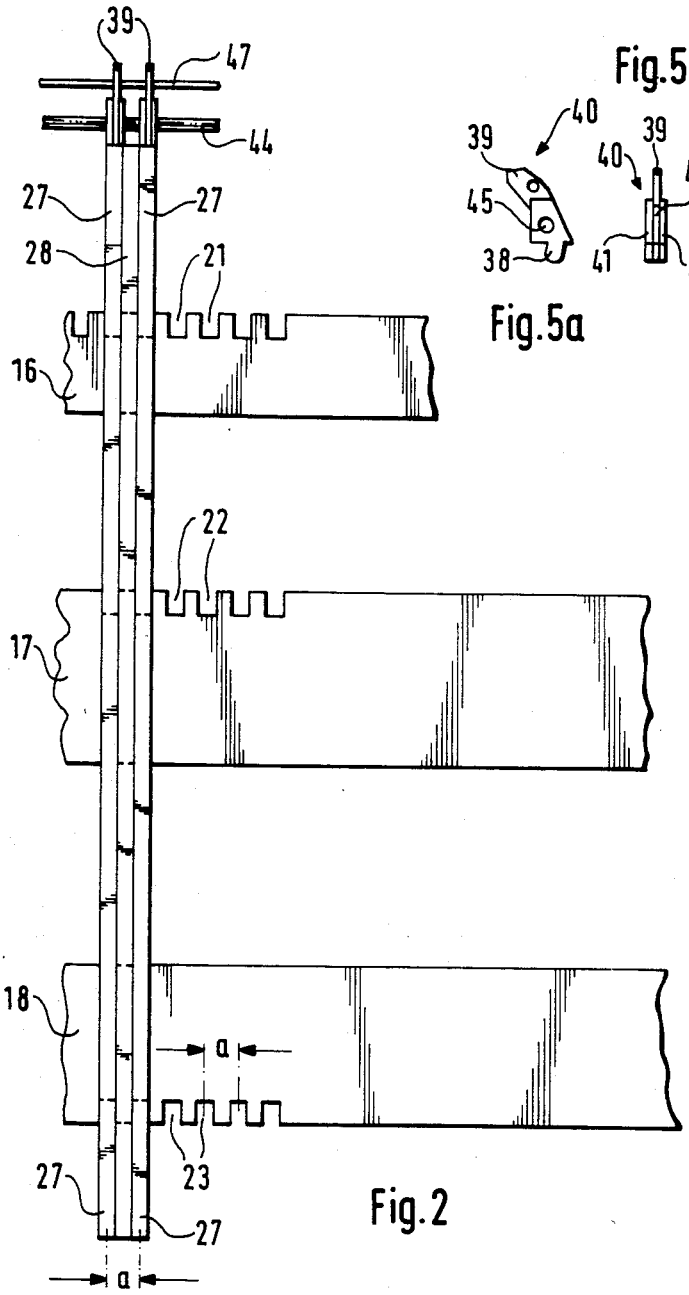
Fig. 2
Fig. 5b
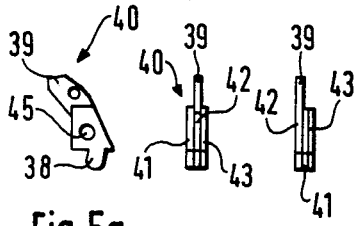
Fig. 5a
Fig. 5c

KNITTING INSTRUMENT CARRIER FOR KNITTING MACHINES

The invention relates to a knitting instrument carrier for knitting machines, for which the stitch forming instruments and associated jacks or instruments are located in grooves (tricks), which are confined by lateral demarcation strips terminating in loop-forming projections in the knitting forming zone and are confined by intermediately positioned bearing strips for the loop-forming instruments, whereby all the demarcation strips and the bearing strips of the knitting instrument carrier are interconnected with each other by means of at least two anchor bars in an interlocking manner in cutouts/recesses of the strips at a distance running transversely in relation to each other.

It has been known for a long time that needles can be guided between guiding strips for circular and flat-bed knitting machines, which are inserted in milled grooves (tricks) of a carrier needle cylinder or needle bed. However, in so doing, solid/sizeable needle cylinders or needle beds have to be used, which involve considerable manufacturing expenditure associated with the grooving (trick cutting). A knitting instrument carrier of the type mentioned in the preamble for which a solid needle bed is no longer provided for carrying the laminations, is disclosed, for example, by FR-PS No. 611 297. Here, the needle bed is virtually reduced to two anchor bars. In practice, it has emerged that for such types of construction, particularly for knitting machines equipped with two needle carriers, important and accurate needle division of the needle carriers, aligned to each other, can no longer be guaranteed. During simple forming of rows of the laminations on anchor bars individual deviations in tolerance in the tolerance range of the laminations or surface inaccuracies accumulate so drastically that alignment of two such knitting instrument carriers is no longer guaranteed. This also applies to the designs disclosed in the literature, for which the loop-forming instruments are coupled together positively with guiding laminations or strips in smaller groups in a row on anchor bars. Attempts have been made to achieve an accurate needle division of needle carriers made up of individual strips with the aid of spacer combs intermeshing between the laminations and predetermining the needle division (DE-AS No. 10 88 656). However, such designs are, on the one hand, very expensive, and, on the other hand, have the disadvantage that the accurate manufacture of the comb projections and the adjustment of the combs in respect to the parts carrying the laminations or strips causes difficulties.

The object of the invention is to design a knitting instrument carrier of the type mentioned in the preamble so that its demarcation strips and the bearing strips form guide grooves for the loop-forming instruments, which ensure an accurate needle division over the entire length of the knitting instrument carrier without the necessity of expensive ancillary designs.

The task set is resolved, in accordance with the invention for one of the knitting instrument carriers corresponding to the type mentioned, by the fact that the common anchor bars in each case are rigidly held under tension on holding bars extending over the entire length of the needle carrier, which are provided in one of their longitudinal sides with edging notches determined at a mutual pitch to the loop-forming instruments and in which the demarcation strips interlock with projections.

For a knitting instrument carrier designed in accordance with the invention, the demarcation strips and the bearing strips are not clamped together in a bank or individually positioned in a row next to each other. Instead, the position of the demarcation strips is held by the holding bars, 'toothed' on their edges in exact correspondence to the desired division of the knitting instrument carrier at predetermined positions. The toothing, accurate to the division (needle gauge) of an individual edge of the holding bars, is considerably less expensive than the forming of a groove/trick over the whole width of a needle bed or a needle cylinder. The accurately grooved holding bars on one of their edges can be anchored securely and accurately aligned to each other on a rigid frame of the knitting instrument carrier, manufactured to suit. The mutual coupling of the strips is produced in a conventional manner by the anchor bars, whilst the exact alignment of the individual guide grooves/tricks for the knitting instruments is provided by the toothed edged holding bars.

Between the bearing strips arranged between the demarcation strips, which are not aligned by the toothed edged holding bars, an additional coupling is made by a wire running transverely to its longitudinal direction, and which also holds the loop-forming projections, which can be produced in a conventional manner separately from the demarcation strips carrying them, whereby the effort expended in manufacture for the individual parts of the knitting instrument carrier can be reduced/simplified still further. For expediency, the loop-forming projections can, in each case, be inserted with a positioning butt in a suitable edge recess of the associated demarcation strips, whereby this edge recess is covered on both sides by neighbouring bearing strips.

The advantageous lamination-like structure of the entire region of guidance for the loop-forming instruments made of stamped out parts can continue right up to the loop-forming projections, which terminate in a free ended nib, which can have at least half the thickness of the remaining section featuring the positioning butt. Even the loop-forming projections can advantageously consist of several laminations laid against each other, of which one lamination is designed having the free ended nib. In adaption to a given type of knitting instrument or a piece of knitting produced on the knitting machines, the lamination having the free ended nib can be arranged at any chosen position between the other laminations of the loop-forming projection.

Further features/embodiments of the invention are mentioned in sub-claims and can be deduced from the enclosed description of an example, aided by the enclosed drawing.

Figure 3:
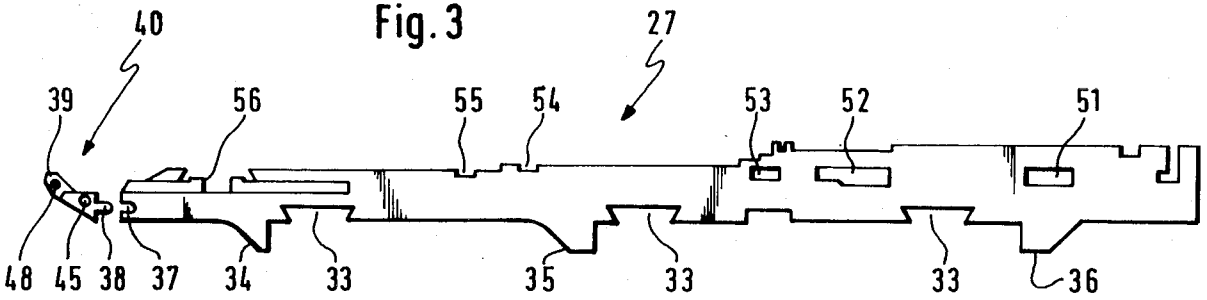
Figure 4:
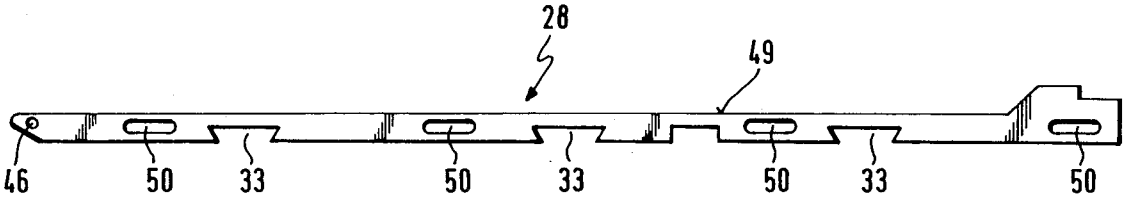

The drawing shows:

FIG. 1 a cross section through the knitting instrument carrier of a V-bed knitting machine, whereby only one of the knitting instrument carriers is fully depicted;

FIG. 2 a schematic part plan on the knitting instrument carrier in the direction of the arrow II in FIG. 1;

FIG. 3 a detailed presentation of a demarcation strip of the knitting instrument carrier;

FIG. 4 a detailed presentation of a bearing strip of the knitting instrument carrier;

FIGS. 5*a*, 5*b*, 5*c* a detailed presentation of a loop-former insertable in a demarcation strip in side elevation and plan view, and having two differing arrangements for the free ended nib of the loop-former.

Only one carrier beam 12 is shown mutually connected to the two knitting instrument carriers 10 and 11, arranged in a conventional manner along the vertical plane of symmetry S in the V-position in the sectional presentation of the frame of a flat bed knitting machine. Each knitting instrument carrier 10 and 11 is designed identically and features a cast structural construction 13 by way of example to which a guide rail 15 is anchored in each case via/over lateral arms 14 for the non-depicted machine carriage of the flat bed knitting machine.

The conventional needle bed is replaced by three holding bars 16, 17 and 18, as knitting instrument carriers, and which run parallel to each other over the entire length of the knitting instrument carrier 10 and 11, and from which the upper holding bar 16 is anchored at individual points to the structural construction 13 via an under-cut slider 20 arranged respectively on a transverse strip 19 in relation to the rail in a manner not worthy of further mention at this point.

As the schematic plan view of FIG. 2 indicates, all three holding bars 16, 17 and 18 are produced with teeth in one of their longitudinal sides by machined grooves 21, 22 or 23 at precisely equal distances. The grooves 21 and 22 are formed in the top edge of the two holding bars 16 and 17, whilst the grooves 23 of the bottom holding bar are formed in the adjacent bottom edge.

The guide channels/tricks for the latch needles 24 and associated needle jacks 25 and selecting instruments 26 as shown in FIG. 1, fitted to the knitting instrument carriers 10 and 11, are confined laterally by demarcation strips 27 depicted individually in FIG. 3 and, in a downwards direction, by bearing strips 28 depicted individually in FIG. 4. The demarcation strips 27 and the bearing strips 28 are designed as stamped out parts. The bearing strip 28 is shown cross hatched in FIG. 1, in order to distinguish it better from the adjacent parts. The alternate demarcation strips 27 and bearing strips 28 following one after the other are all in rows on three common anchor bars 29, 30 and 31, which have a trapezoidal cross section and, in accordance with FIG. 1 are secured by means of screws 32 on one of the three holding bars 16, 17 or 18 respectively. For the acceptance of the anchor bars 29, 30 and 31 the demarcation strips 27 and the bearing strips 28 are provided with identical wedge/V-shaped cutouts 33 on their bottom edge. The mutual distance a of the demarcation strips 27 is not determined by the thickness of the demarcation strips 27 or the bearing strips 28, but by the grooves 21, 22 and 23 of the holding strips 16, 17 and 18, in which each demarcation strip 27 meshes with three of its projections 34, 35 and 36 formed on the underside. Consequently, the mutual distance of the demarcation strips 27 always corresponds accurately at each position of the long knitting instrument carrier 10 and 11 to the distance a and, therefore, to the needle division/gauge of the flat bed knitting machine.

The demarcation strips 27 are provided with a recess/cutout 37 at their front or upper end, which is covered on both sides by the end zones of the adjacent bearing strip 28. A suitably designed butt 38 of a separate designed loop-forming projection 40 fits into this recess 37, the projection of which terminates in a thinner free ended nib 39, pointing upwards in a conventional manner. As the detailed presentation of the loop-forming projection 40 in FIGS. 5*b* and 5*c* shows, it consists of three small stamped out plates 41, 42 and 43, lying against each other, of which the nib 39 is formed solely on plate 42, but together form the butt 38. The three small stamped out plates 41–43 can be connected together in random sequence, such for example that the stamped out plate 42 forming the nib 39, in accordance with FIG. 5*b*, is arranged between the two other plates 41 and 43 or, in accordance with 5*c*, is arranged on the outside of the bank of plates. In their inserted position the loop-forming projections 40 are held by means of a first wire 44 illustrated in FIG. 2, and which is guided through an opening 45 formed in all the small stamped out plates 41 to 43 and through an opening 46 formed in the front end of the bearing strips 28. The loop knock-over edge (casting off of loop) of the knitting instrument carriers is formed by a second wire 47, also illustrated in FIG. 2, and which is guided through an opening 48 in the free ended nib 39 of the loop-forming projections 40.

The bearing strips 28, on whose upper side 49 the needles 24 and the needle jacks 25 slide, are provided with several cutouts 50 to save weight. In the demarcation strips 27 in accordance with FIG. 3 are formed internal cutouts 51, 52 and 53, plus upper edge cutouts 54, 55 and 56 for sundry point bars and striker bars 57–62 illustrated in FIG. 1.

The inclined position of the knitting instrument carrier comprising the holding bars, the anchor bars and the demarcation and bearing strips, plus the point and striker bars can be set by stop screws 63, indicated in FIG. 1, and attached to the structure 13, against which the holding bars 16–18 lie.

We claim:

1. A knitting instrument carrier for knitting machines, comprising loop-forming instruments and associated jacks which are located in grooves and confined by lateral demarcation strips, terminating in the knitting forming zone in loop-forming projections and by bearing strips lying in between for the loop-forming instrument, means for coupling together all demarcation strips and bearing strips of the knitting instrument carrier, said means including at least two anchor bars meshing in an interlocking manner in cutouts of the strips running transversely at a distance to each other, the anchor bars securely clamped in each case on holding bars which extend over the entire length of the knitting instrument carrier and which are provided on one of their longitudinal sides with edge grooves, which grooves determine the mutual distance of the loop-forming instruments, in which the projections of the demarcation strips mesh.

2. A knitting instrument carrier in accordance with claim 1, including means for coupling the bearing strips together on their knitting zone, which means includes a first wire running transversely to the longitudinal direction of the bearing strips, which wire also holds the loop-forming projections, wherein the projections are separate elements from their respective demarcation strips.

3. A knitting instrument in accordance with claim 1, wherein the loop-forming projections are inserted in each case, by a butt, into an edge cutout of the associated demarcation strips and said edge cutout is covered on both sides by neighbouring bearing strips.

4. A knitting instrument carrier in accordance with claim 1, wherein the loop forming projections terminate in a free ended nib, which nib has a thickness at least half of the remaining part of the butt.

5. A knitting instrument carrier in accordance with claim 1, wherein the loop-forming projections comprise several laminations lying against each other, of which one lamination has the free ended nib thereon.

6. A knitting instrument carrier in accordance with claim 5, wherein the lamination provided with a free ended nib can be arranged at any chosen position between or next to the other laminations of the loop-forming projection.

7. A knitting instrument carrier in accordance with claim 1, wherein the knock-over edge of the knitting instrument carrier includes a second wire arranged in a conventional manner, which second wire is guided through an opening in the free ended nib of the loop-forming projections and runs parallel to the first wire, which is guided through an opening formed in the thicker part of the loop-forming projections.

8. A knitting instrument carrier in accordance with claim 1, wherein three holding bars are provided and run parallel to each other, of which two are provided on the same longitudinal edge and the other on the opposite longitudinal edge with equally divided grooves for three projections of the demarcation strips.

* * * * *